US009106032B2

(12) United States Patent
Chang

(10) Patent No.: US 9,106,032 B2
(45) Date of Patent: Aug. 11, 2015

(54) STACKING CONNECTOR HAVING A RJ-45 CONNECTOR STACKED OVER A USB CONNECTOR WITH POWER AND GROUND PINS

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 14/271,447

(22) Filed: May 6, 2014

(65) Prior Publication Data

US 2014/0342617 A1 Nov. 20, 2014

(30) Foreign Application Priority Data

May 14, 2013 (TW) ..... 102208935 U

(51) Int. Cl.

| | |
|---|---|
| ***H01R 13/60*** | (2006.01) |
| ***H01R 13/66*** | (2006.01) |
| ***H01R 27/02*** | (2006.01) |
| ***H01R 24/64*** | (2011.01) |
| ***H01R 12/50*** | (2011.01) |
| *H01R 12/72* | (2011.01) |

(52) U.S. Cl.

CPC ..... *H01R 27/02* (2013.01); *H01R 23/7073* (2013.01); *H01R 24/64* (2013.01); *H01R 12/722* (2013.01)

(58) Field of Classification Search

CPC .. H01R 13/514; H01R 27/02; H01R 13/6873; H01R 13/7073

USPC ..... 439/676, 541.5

See application file for complete search history.

(56) References Cited

U.S. PATENT DOCUMENTS

| | | | | |
|---|---|---|---|---|
| 6,159,039 | A * | 12/2000 | Wu | 439/541.5 |
| 6,162,089 | A * | 12/2000 | Costello et al. | 439/541.5 |
| 6,368,151 | B1 * | 4/2002 | Chen et al. | 439/541.5 |
| 6,478,610 | B1 * | 11/2002 | Zhou et al. | 439/490 |
| 6,540,563 | B1 * | 4/2003 | Hu et al. | 439/676 |
| 8,333,599 | B2 * | 12/2012 | Xu et al. | 439/76.1 |
| 2003/0008553 | A1 * | 1/2003 | Oleynick et al. | 439/541.5 |
| 2004/0224558 | A1 * | 11/2004 | Wan et al. | 439/541.5 |
| 2005/0106939 | A1 * | 5/2005 | Zhang et al. | 439/607 |
| 2014/0220796 | A1 * | 8/2014 | Chang | 439/64 |

* cited by examiner

*Primary Examiner* — Chandrika Prasad

(74) *Attorney, Agent, or Firm* — Chun-Ming Shih; HDLS IPS Services

(57) ABSTRACT

A stacking connector comprises an insulating body, a plurality of connection terminals and a USB connector. The insulating body has a first containing space and a second containing space. A plurality of terminal slots is defined in a connection port of the insulating body and communicates with the first containing space. The plurality of connection terminals is configured in the first containing space, and exposed to the connection port to constitute a RJ-45 connector with the connection port. The USB connector is configured in the second containing space. Power pin and ground pin of the USB connector are electrically connected to NC pins of the plurality of connection terminals separately. Therefore, the USB connector receives power from a mainboard to provide to the RJ-45 connector. In contrary, the RJ-45 connector receives power by way of PoE to provide to the USB connector.

10 Claims, 8 Drawing Sheets

STACKING CONNECTOR HAVING A RJ-45 CONNECTOR STACKED OVER A USB CONNECTOR WITH POWER AND GROUND PINS

BACKGROUND OF THE INVENTION

1. Field of the Invention

The present invention relates to a stacking connector, and in particular to a stacking connector having two connectors which are connected to each other in part.

2. Description of Related Art

Following the development of electronic industrial, electronic devices are popular now and all around people in day life. Commonly, the electronic devices are usually configured more than one connector on mainboard for receiving control command to operate, or transmitting data between two electronic devices.

Amount and type of peripherals of electronic devices become more and more, it brings user demand of connectors of the electronic devices, too. As the result, the amount of build-in connectors in a signal electronic device increases in nowadays. However, if the amount of build-in connectors in the electronic device increases, the build-in connectors will occupy configuration space of the electronic device. Therefore, the size of the electronic device will difficult to be reduced.

For solving above problem, a stacking connector is proposed in the market. The stacking connector stacks multiple connectors with same or different interface vertically and the occupied space on mainboard is corresponding to single connector space, therefore, exchanges vertical space with horizontal space. A mainboard of the electronic device can be capable of multiple connectors via configuring one stacking connector, and the stacking connector will only occupy single connector's space. Therefore, the configuration space of the mainboard is saved, and the saved space can be used to configure another components. In other hand, the size of the mainboard will be reduced.

Although there are multiple connectors on single stacking connector, however, those connectors can't connect to each other, and can't transmit signal to each other. For example, although one stacking connector comprises a RJ-45 connector and a USB connector thereon, and the RJ-45 connector can support power over ethernet (PoE) function, however, the RJ-45 connector can't provide power received via PoE to the USB connector anyway. In contrary, even the USB connector receives power from the mainboard of the electronic device, however, the received power can't be provided from the USB connector to the RJ-45 connector.

As mentioned above, how to use the nowadays stacking connectors more efficient, will be the main objective to be researched in this area.

SUMMARY OF THE INVENTION

The main objective of the present invention is to provide a stacking connector, which can provide power from a USB connector to a RJ-45 connector, or provide power from the RJ-45 connector to the USB connector, so as to support power to each other in the stacking connector.

To achieving above objective, the stacking connector of the present invention comprises an insulating body, a plurality of connection terminals and a USB connector. The insulating body has a first containing space and a second containing space. A plurality of terminal slots is defined in a connection port of the insulating body and passed through the first containing space. The plurality of connection terminals is configured in the first containing space, and exposed to the connection port to constitute a RJ-45 connector with the connection port. The USB connector is configured in the second containing space. Power pin and ground pin of the USB connector are electrically connected to NC pins of the plurality of connection terminals separately. Therefore, the USB connector receives power from a mainboard to provide to the RJ-45 connector. In contrary, the RJ-45 connector receives power by way of power over ethernet (PoE) to provide to the USB connector.

Power pin and ground pin of the USB connector are electrically connected to NC pins of the RJ-45 connector in the present stacking connector, so power can be delivered between the USB connector and the RJ-45 connector. Therefore, when receiving power from computer mainboard, the USB connector can provide received power to the RJ-45 connector, and the RJ-45 connector can support external network devices by way of power over ethernet (PoE).

In the other hand, if the RJ-45 connector of the stacking connector supports PoE technology, it can receive power from the external network devices to provide to the USB connector, and devices connected with the USB connector can receive power from the USB connector for charging.

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
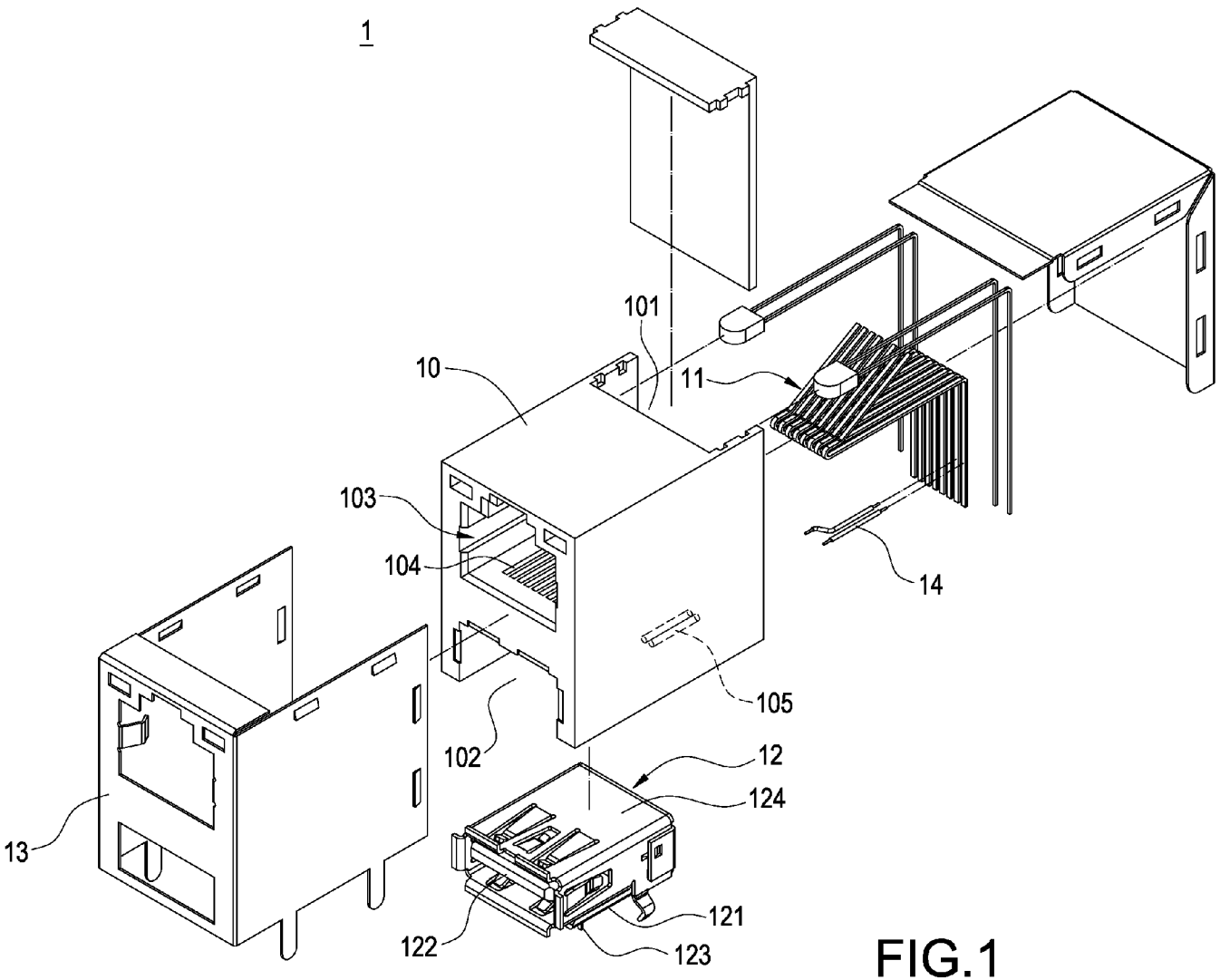
FIG. 1 is an exploded perspective view of a first embodiment according to the present invention.
Figure 2:
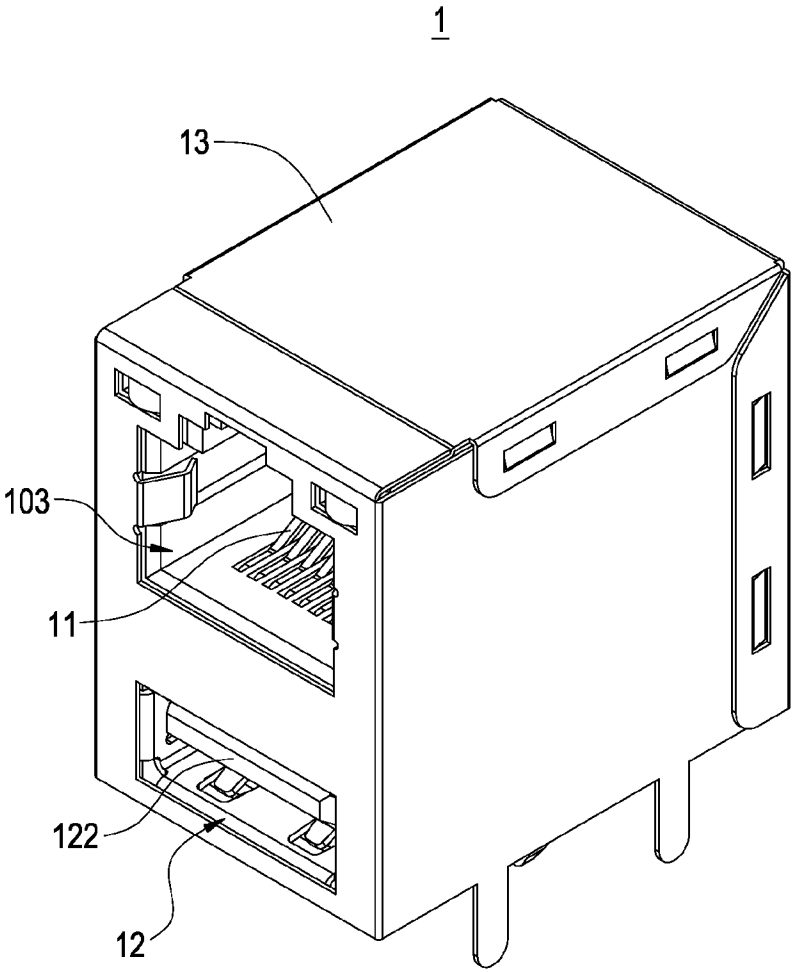
FIG. 2 is a combination perspective view of the first embodiment according to the present invention.

FIG. 1 is an exploded perspective view of a first embodiment according to the present invention. FIG. 2 is a combination perspective view of the first embodiment according to the present invention. The present invention discloses a stacking connector 1 having power supporting function. As shown in FIG. 1 and FIG. 2, the stacking connector 1 comprises an insulating body 10, a plurality of connection terminals 11, a universal serial bus (USB) connector 12, and a metal case 13.

The insulating body 10 has a front face and a corresponding rear face. A first containing space 101 is defined inward from the rear face. A second containing space 102 and a connection port 103 are defined inward from the front face. In this embodiment, the shape of the connection port 103 is corresponding to that of a RJ-45 connector, and in particular, the connection port 103 is a RJ-45 connection port. A plurality of terminal slots 104 is defined in the connection port 103, and each of the plurality of terminal slots 104 is passed through the connection port 103 and the first containing space 101 separately.

The plurality of connection terminals 11 are configured in the first containing space 101. One end of each of the plurality of connection terminals 11 is configured in one of the plurality of terminal slots 104, extended frontward through each of the plurality of terminal slots 104, and exposed in the connection port 103. Therefore, the plurality of connection terminals 11 constitutes a RJ-45 connector with the connection port 103. In this embodiment, the other end of each of the plurality of connection terminals 11 is extended downward and out of a bottom of the insulating body 10, so as to electrically connect with a mainboard (as the mainboard 2 shown in FIG. 3) of an external electronic device for delivering network related signal thereto.

The USB connector 12 is configured in the second containing space 102, and constitutes the present stacking connector 1 with the above mentioned RJ-45 connector. The USB connector 12 mainly comprises a seat body 121, a plurality of conductive terminals 123 and a housing 124. The seat body 121 has a tongue 122 which is extended from a front face of the seat body 121. One end of each of the plurality of conductive terminals 123 is configured in the tongue 122 separately, and the other end of each of the plurality of conductive terminals 123 is extended downward and out of a bottom of the USB connector 12 and the bottom of the insulating body 10. Therefore, the USB connector 12 can electrically connect with the mainboard 2 for delivering USB type signal thereto.

The housing 124 is configured to encapsulate the seat body 121 and the plurality of conductive terminals 123, so as to provide shielding effect to the USB connector 12. The metal case 13 is configured to encapsulate the insulating body 10, the plurality of connection terminals 11 and the USB connector 12, so as to provide shielding effect to the whole stacking connector 1.

Figure 3:
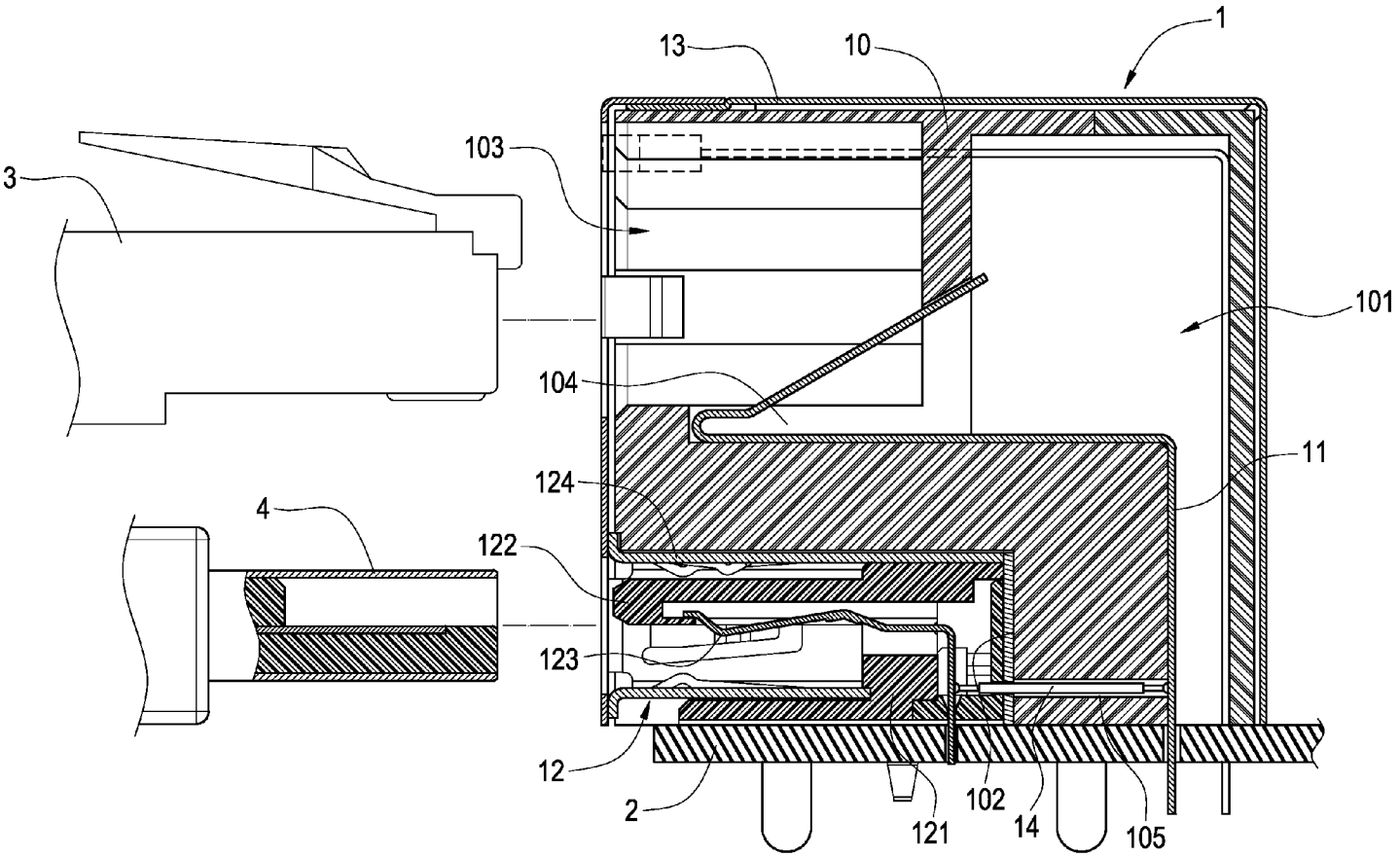
FIG. 3 is a section view of the first embodiment according to the present invention.

FIG. 3 is a section view of the first embodiment according to the present invention. The plurality of conductive terminals 123 of the USB connector 12 includes a power pin and a ground pin. The main feature of the present invention is that the power pin and the ground pin of the USB connector 12 are electrically connected to two pins of the plurality of connection terminals 11 of the RJ-45 connector separately, wherein the two pins connected with power pin and the ground pin of the USB connector 12 are not-connected (NC) pins of the RJ-45 connector.

As shown in FIG. 3, the stacking connector 1 has a through slot 105 in the insulating body 10, and the through slot 105 is communicated with the first containing space 101 and the second containing space 102. At least one connection wire 14 is configured in the through slot 105, wherein one end of each of the at least one connection wire 14 is electrically connected to the power pin and the ground pin of the USB connector 12, and the other end of each of the at least one connection wire 14 is electrically connected to the two NC pins of the RJ-45 connector.

According to the present invention, when the stacking connector 1 is set on the mainboard 2, the USB connector 12 of the stacking connector 1 can receive power from the mainboard 2 through the power pin and the ground pin, and further deliver the received power to the RJ-45 connector through the at least one connection wire 14. Therefore, the RJ-45 connector of the stacking connector 1 can connect with network devices (not shown) supported power over ethernet (PoE) function through a network cable 3, and provide power to the network devices by way of PoE function.

In contrary, if the mainboard 2 stops outputting power (for example, a computer of the mainboard 2 is shut down), the RJ-45 connector of the stacking connector 1 can still receive power from the connected network devices through the network cable 3 by way of PoE technology. In this circumstance, the RJ-45 connector can further provide the received power to the USB connector 12 through the connection wire 14. Therefore, the USB connector 12 can provide power to an external device (not shown) electrically connected with the USB connector 12 through a USB cable 4 even the mainboard 2 stops outputting power. It is to say, the USB connector 12 and the RJ-45 connector of the stacking connector 1 according the present invention can support and provide power to each other.

In the above embodiment, the power pin and the ground pin of the USB connector 12 are connected to the two NC pins of the RJ-45 connector through the at least one connection wire 14. In other embodiment, however, the at least one connection wire 14 can be replaced with a metal pin, but not intended to limit the scope of the present invention. In particularly, any component made of electric-conductive material and having at least two ends to electrically connect the power pin and the ground pin with the NC pins of the RJ-45 connector is adaptive for the stacking connector 1 of the present invention.

Figure 4:
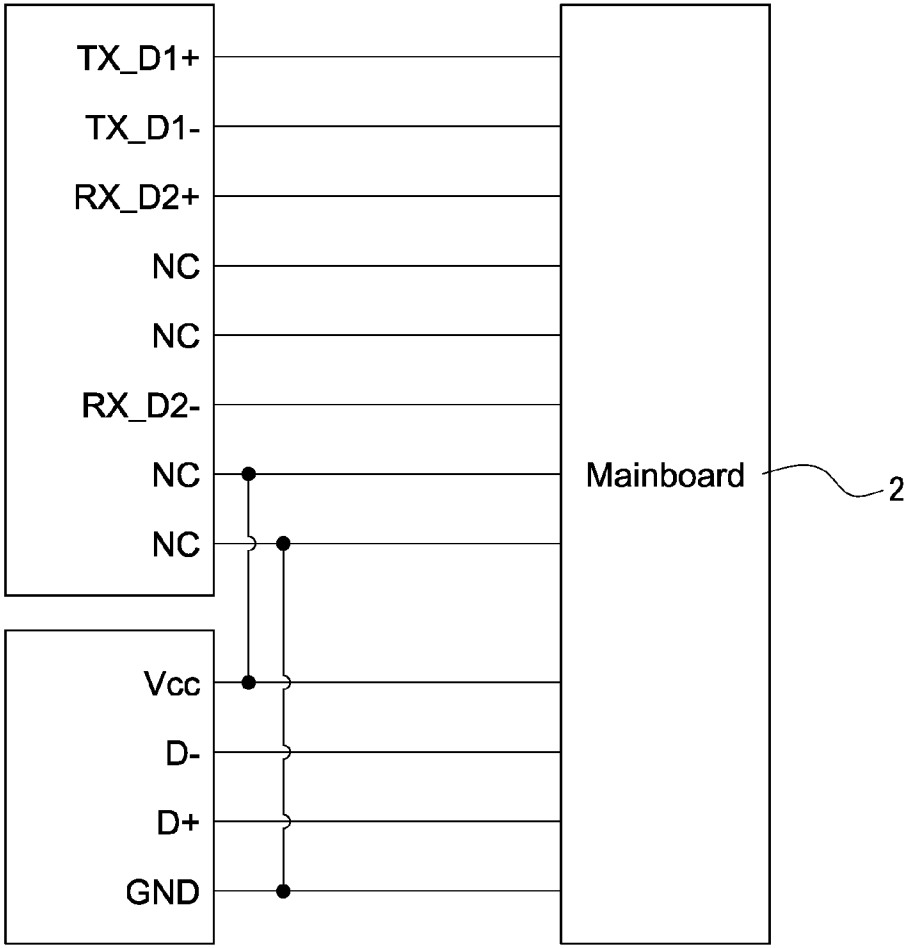
FIG. 4 is a perspective view showing circuit connection of the first embodiment according to the present invention.

FIG. 4 is a perspective view showing circuit connection of the first embodiment according to the present invention. As shown in FIG. 4, an amount of the plurality of connection terminals 11 is eight (an amount of the plurality of terminal slots 104 is eight correspondingly), and the pin define of the eight connection terminals 11 is: (1) positive signal transmission (TX_D1+), (2) negative signal transmission (TX_D1−), (3) positive signal receiving (RX_D2+), (4) not-connected (N.C), (5) not-connected (N.C), (6) negative signal receiving (RX_D2−), (7) not-connected (N.C), (8) not-connected (N.C). One end of each of the eight connection terminals 11 is exposed in the connection port 103 separately for connecting with the network cable 3, and the other end of each of the eight connection terminals 11 is electrically connected with the mainboard 2 separately for delivering network related signal thereto.

In this embodiment, the USB connector 12 is depicted as a USB 2.0 connector, but not limited to. An amount of the plurality of conductive terminals 123 of the USB connector 12 is four, and the pin define of the four conductive terminals 123 is: (1) power (Vcc), (2) negative signal (D−), (3) positive signal (D+), (4) ground (GND). One end of each of the four conductive terminals 123 is configured in the tongue 122 separately for connecting with the USB cable 4, and the other end of each of the four conductive terminals 123 is electrically connected with the mainboard separately for delivering USB type signal thereto.

As shown in FIG. 4, the power pin and the ground pin of the plurality of conductive terminals 123 (the $1^{st}$ pin and the $4^{th}$ pin shown in FIG. 4) are electrically connected to two NC pins of the plurality of connection terminals 11 (for example, the $7^{th}$ pin and the $8^{th}$ pin shown in FIG. 4) separately. Therefore, the RJ-45 connector can deliver power through the two NC pins. The present embodiment connects the $1^{st}$ pin and the $4^{th}$ pin of the USB connector 12 to the $7^{th}$ pin and the $8^{th}$ pin of the RJ-45 connector, however, all NC pins of the RJ-45 connector can be used to connect with the USB connector 12. For example, the $1^{st}$ pin and the $4^{th}$ pin of the USB connector 12 can also be electrically connected to the $4^{th}$ pin and the $5^{th}$ pin of the RJ-45 connector, or be electrically connected to the $5^{th}$ pin and the $8^{th}$ pin of the RJ-45 connector, but not intended to limit the scope of the present invention.

Figure 5:
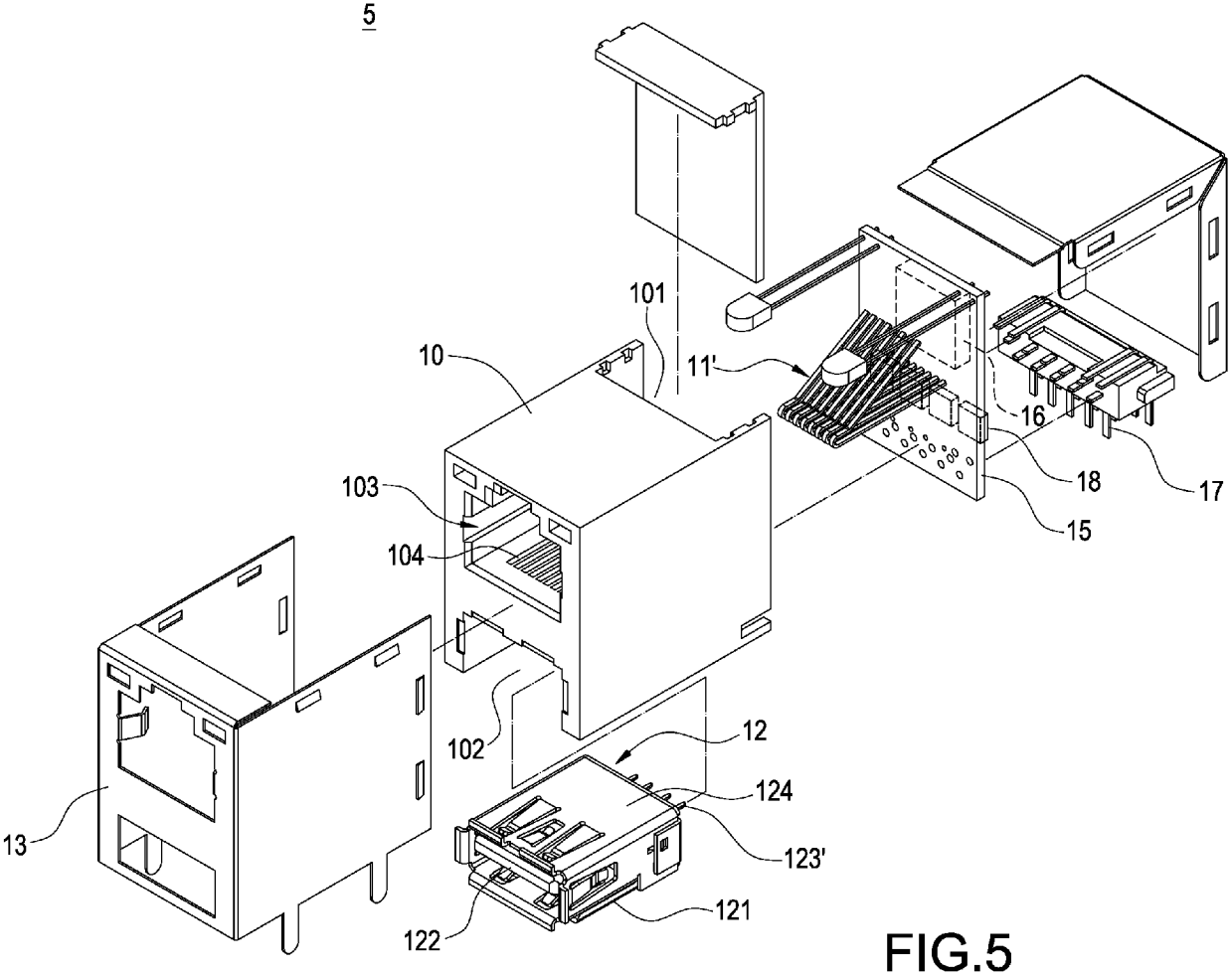
FIG. 5 is an exploded perspective view of a second embodiment according to the present invention.
Figure 6:
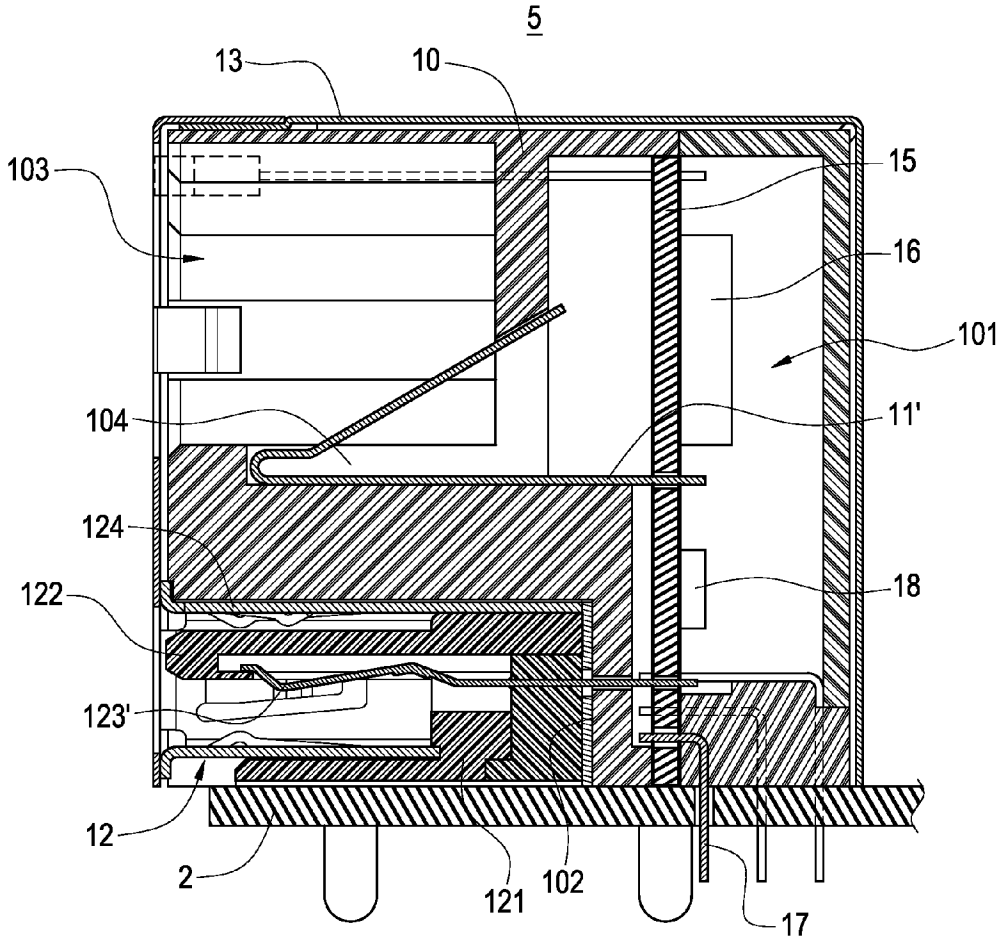
FIG. 6 is a section view of the second embodiment according to the present invention.

FIG. 5 is an exploded perspective view of a second embodiment according to the present invention. FIG. 6 is a section view of the second embodiment according to the present invention. The second embodiment discloses another stacking connector 5. The difference between the stacking connector 5 and the stacking connector 1 in the first embodiment is the stacking connector 5 further comprises a circuit board 15, and the stacking connector 5 replaces the plurality of connection terminals 11 and conductive terminals 123 of the stacking connector 1 with a plurality of connection terminals 11' and conductive terminals 123'

In this embodiment, the circuit board 15 is configured in the first containing space 101. The other end of each of the plurality of connection terminals 11' is electrically connected to the circuit board 15, and the other end of each of the plurality of conductive terminals 123' is electrically connected to the circuit board 15. The power pin and the ground pin of the USB connector 12 are electrically connected with the two NC pins of the RJ-45 connector through the circuit board 15.

As shown in FIG. 5, the stacking connector 5 further comprises a plurality of linking terminals 17. One end of each of the plurality of linking terminals 17 is electrically connected to the circuit board 15 separately, and the other end of each of the plurality of linking terminals 17 is extended downward and out of the bottom of the insulating body 10 for electrically connecting with the mainboard 2. It is to say, the plurality of connection terminals 11' and conductive terminals 123' are electrically connected to the mainboard 2 through the circuit board 15 and the plurality of linking terminals 17 for delivering network related signal and USB type signal thereto.

It should be mentioned is an amount of the plurality of linking terminals 17 is corresponding to the total amount of the plurality of connection terminals 11' and conductive terminals 123'. In this embodiment, the amount of the plurality of connection terminals 11' is eight, and the amount of the plurality of conductive terminals 123' is four. As the standard mentioned above, the amount of the plurality of linking terminals 17 is twelve. However, above description is just a preferred embodiment, not intended to limit the scope of the present invention.

As shown in FIG. 5 and FIG. 6, the stacking connector 5 further comprises a transformer 16 and at least one protection component 18. The transformer 16 is electrically connected to the circuit board 15, and further connected with the RJ-45 connector through the circuit board 15. In particularly, the transformer 16 is electrically connected with the plurality of connection terminals 11' of the RJ-45 connector through the circuit board 15.

The at least one protection component 18 is electrically connected to the circuit board 15, and further connected with the RJ-45 connector and the transformer 16 through the circuit board 15. In particularly, the at least one protection component 18 is electrically connected with the plurality of connection terminals 11' of the RJ-45 connector through the circuit board 15. The at least one protection component 18 in this embodiment provides protection function for the RJ-45 connector, and it can be, for example, a resistance, a capacitance, a transient voltage suppressor (TVS), or a gas discharge tube (GDT), but not limited to.

Figure 7:
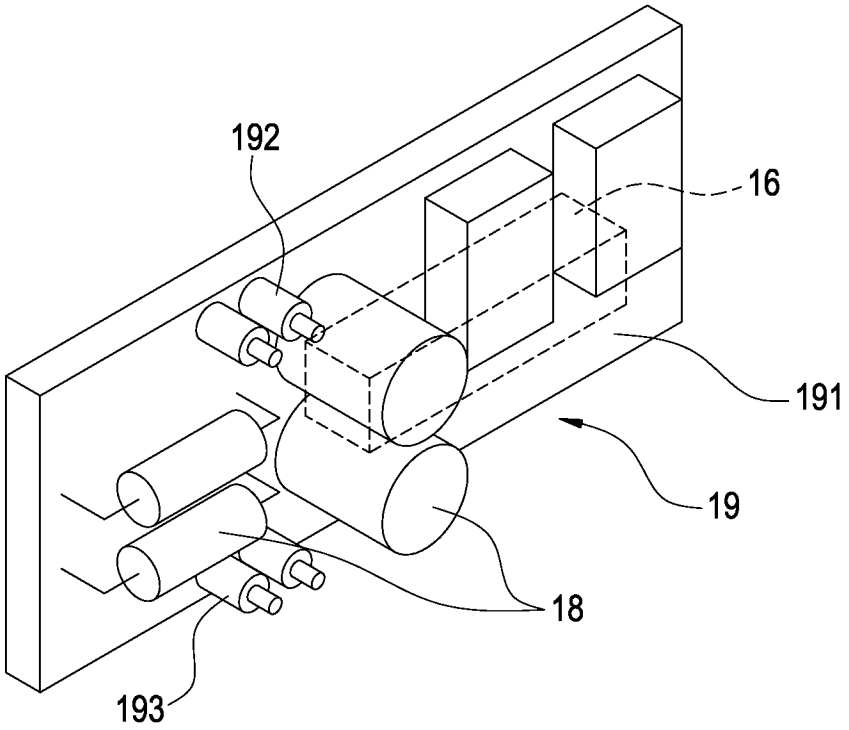
FIG. 7 is a perspective view of a transformer module of a first embodiment according to the present invention.

FIG. 7 is a perspective view of a transformer module of a first embodiment according to the present invention. In this embodiment, the transformer 16 described in the above embodiment can be replaced with a transformer module 19. As shown in FIG. 7, the transformer module 19 mainly comprises the transformer 16 and a second circuit board 191, wherein the second circuit board 191 is stacked on top side of the transformer 16, and electrically connected thereto. The above mentioned protection component 18 can be also set on the second circuit board 191 in this embodiment, and electrically connected with the transformer 16 through the second circuit board 191.

Figure 8:
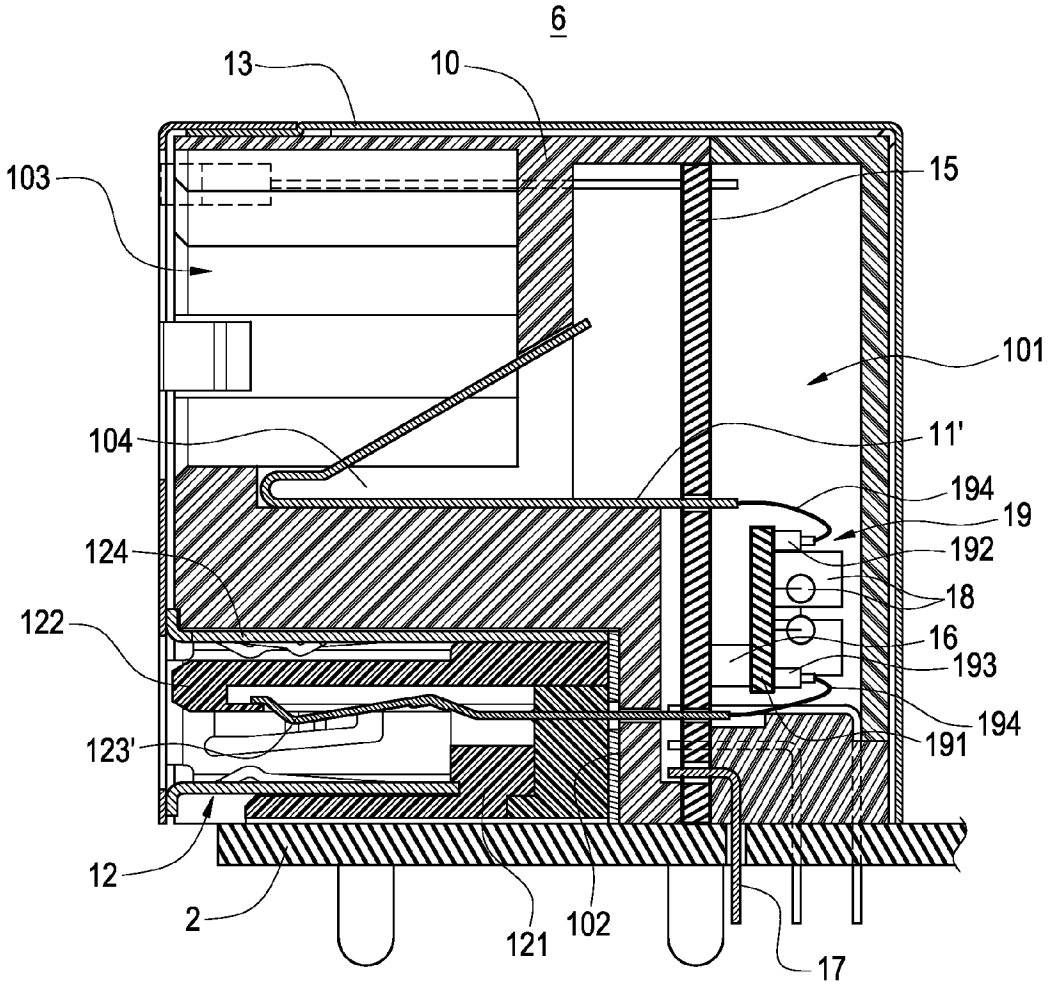
FIG. 8 is a section view of a third embodiment according to the present invention.

FIG. 8 is a section view of a third embodiment according to the present invention. FIG. 8 discloses another stacking connector 6. The difference between the stacking connector 6 and the above mentioned stacking connector 5 is the stacking connector 6 replaces the transformer 16 of the stacking connector 5 with the transformer module 19. As shown in FIG. 8, the circuit board 15 and the transformer module 19 (comprising the transformer 16 and the second circuit board 191) are configured in the first containing space 101 separately. The other end of each of the plurality of connection terminals 11' is electrically connected to the circuit board 15 separately, and the other end of each of the plurality of conductive terminals 123' is also electrically connected to the circuit board 15 separately.

The transformer 16 is electrically connected to the circuit board 15, and further electrically connected to the RJ-45 connector through the circuit board 15. The second circuit board 191 is stacked on the top side of the transformer 16, and electrically connected thereto. The at least one protection component 18 is configured on the second circuit board 191, and electrically connected with the transformer 16 through the second circuit board 191.

The most difference between the stacking connector 6 and the stacking connector 5 is the power pin and the ground pin of the USB connector 12 of the stacking connector 6 are electrically connected with the two NC pins of the RJ-45 connector of the stacking connector 6 through the second circuit board 191. In particularly, as shown in FIG. 7 and FIG. 8, at least one first pin socket 192 and at least one second pin socket 193 are configured on the second circuit board 191, and the at least one first pin socket 192 is electrically connected with the second pin socket 193 through the second circuit board 191. In this embodiment, an amount of the at least one first pin socket 192 is two, and an amount of the at least one second pin socket 193 is two, but not limited to.

The first pin socket 192 and the second pin socket 193 are connected with external cable 194 separately. The first pin sockets 192 are electrically connected with the two NC pins of the RJ-45 connector through the cable 194. And the second pin sockets 193 are electrically connected with the power pin and the ground pin of the USB connector 12 through another cable 194. It is to say, the power pin and the ground pin of the USB connector 12 are electrically connected to the two NC pins of the RJ-45 connector through the cables 194, the first pin sockets 192, the second pin sockets 193, and the second circuit board 191 for delivering power between the USB connector 12 and the RJ-45 connector.

Although the present invention has been described with reference to the foregoing preferred embodiments, it will be understood that the invention is not limited to the description thereof. Any equivalent variations and modifications can be made to those skilled in the art in view of the teaching of the present invention are also in the scope of the invention as defined in the appended claims.

What is claimed is:

1. A stacking connector comprising:

an insulating body having a first containing space defined inward from a rear face, and having a second containing space and a connection port defined inward from a front face, and a plurality of terminal slots being defined in the connection port and passed through the connection port and the first containing space;

a plurality of connection terminals, being configured in the first containing space, one end of each of the plurality of connection terminals being extended frontward through the plurality of terminal slots and exposed in the connection port, so as to constitute a RJ-45 connector with the connection port;

a USB connector being configured in the second containing space, the USB connector comprising a plurality of conductive terminals, a power pin and a ground pin of the plurality of conductive terminals being electrically connected to two pins of the plurality of connection terminals separately, the two connected pins being not-connected (NC) pins of the RJ-45 connector; and a metal case, encapsulating the insulating body, the plurality of connection terminals and the USB connector for proving shielding effect.

2. The stacking connector according to claim 1, wherein the insulating body has a through slot communicated with the first containing space and the second containing space, wherein the stacking connector further comprises at least one connection wire configured in the through slot, and the power pin and the ground pin of the USB connector are electrically connected to the two NC pins of the RJ-45 connector through the at least one connection wire.

3. The stacking connector according to claim 1, wherein the insulating body has a through slot communicated with the first containing space and the second containing space, wherein the stacking connector further comprises at least one metal pin configured in the through slot, and the power pin and the ground pin of the USB connector are electrically connected to the two NC pins of the RJ-45 connector through the at least one metal pin.

4. The stacking connector according to claim 1, further comprises a circuit board configured in the first containing space, wherein the other end of each of the plurality of connection terminals is electrically connected to the circuit board separately, and the other end of each of the plurality of conductive terminals is electrically connected to the circuit board separately, and the power pin and the ground pin of the USB connector are electrically connected to the two NC pins of the RJ-45 connector separately through the circuit board.

5. The stacking connector according to claim 4, further comprises a plurality of linking terminals, one end of each of the plurality of linking terminals is electrically connected to the circuit board separately, and the other end of each of the plurality of linking terminals is extended downward and out of a bottom of the insulating body, wherein an amount of the plurality of linking terminals is corresponding to a total amount of the plurality of connection terminals and conductive terminals.

6. The stacking connector according to claim 4, further comprises a transformer electrically connected to the circuit board, and further electrically connected to the RJ-45 connector through the circuit board.

7. The stacking connector according to claim 6, further comprises at least one protection component electrically connected to the circuit board, and further electrically connected to the RJ-45 connector and the transformer through the circuit board.

8. The stacking connector according to claim 6, further comprises a second circuit board and at least one protection component, wherein the second circuit board is stacked on a top side of the transformer and electrically connected thereto, and the at least one protection component is electrically connected to the second circuit board, and further electrically connected to the transformer through the second circuit board.

9. The stacking connector according to claim 1, further comprises a circuit board, a transformer and a second circuit board, which are configured in the first containing space, the other end of each of the plurality of connection terminals and the plurality of conductive terminals are electrically connected to the circuit board separately, the transformer is electrically connected to the circuit board, and further electrically connected to the RJ-45 connector through the circuit board, and the second circuit board is stacked on a top side of the transformer and electrically connected thereto, wherein the power pin and the ground pin of the USB connector are electrically connected to the two NC pins of the RJ-45 connector through the second circuit board.

10. The stacking connector according to claim 9, wherein the second circuit board configures at least one first pin socket and at least one second pin socket electrically connected to the at least one first pin socket, wherein the at least one first pin socket is electrically connected to the two NC pins of the RJ-45 connector through an external cable, and the at least one second pin socket is electrically connected to the power pin and the ground pin of the USB connector through another external cable.

* * * * *